United States Patent [19]

Wolfbauer, III

[11] Patent Number: 4,961,317

[45] Date of Patent: Oct. 9, 1990

[54] OLEOPNEUMATIC INTENSIFIER CYLINDER

[75] Inventor: Michael H. Wolfbauer, III, Roseville, Mich.

[73] Assignee: Savair, Inc., St. Clair Shores, Mich.

[21] Appl. No.: 408,920

[22] Filed: Sep. 18, 1989

[51] Int. Cl.[5] ..... F15B 15/22

[52] U.S. Cl. ..... 60/560; 60/567; 60/589; 91/4 R

[58] Field of Search ..... 91/4 R; 60/533, 560, 60/567, 576, 503, 583, 589

[56] References Cited

U.S. PATENT DOCUMENTS

| | | | |
|---|---|---|---|
| 3,426,530 | 2/1969 | Georgelin | 60/560 |
| 4,099,436 | 7/1978 | Beneteau | 60/560 |
| 4,395,027 | 7/1983 | Nordmeyer | 60/583 |
| 4,419,862 | 12/1983 | Farr | 60/576 |
| 4,455,831 | 6/1984 | Maehara | 60/589 |
| 4,671,168 | 6/1987 | Sauvee et al. | 60/589 |
| 4,736,588 | 4/1988 | Leiber | 60/589 |

*Primary Examiner*—Ronald C. Capossela
*Attorney, Agent, or Firm*—Remy J. VanOphem

[57] ABSTRACT

An oleopneumatic load intensifier apparatus for creating a rapid advance of a tool carrying piston rod followed by slow advance of the piston rod at an increased load. The apparatus has a master cylinder and an actuating cylinder that can assume different positions with respect to the master cylidner while maintaining fluid communication therewith. An enclosed hydraulic system is shared by the master and actuating cylinders. Pneumatic pressure actuates a piston within the master cylinder that causes a rapid advancement of a hydraulic fed piston within the actuating cylinder, causing a piston rod and a tool associated therewith to contact a workpiece. Pneumatic pressure then causes a piston and associated piston rod, located in the master cylinder, to increase the hydraulic pressure in the line to the hydraulic fed piston located within the actuating cylinder, thus, increasing the load delivered to the workpiece.

36 Claims, 4 Drawing Sheets

OLEOPNEUMATIC INTENSIFIER CYLINDER

BACKGROUND OF THE INVENTION

1. FIELD OF THE INVENTION

The present invention relates to a fluid powered apparatus that has application for clamping, punching, welding and other functions that are necessary in the manufacture and assembly of machines and vehicles such as automobiles. More particularly, the invention is related to a dual action fluid powered apparatus designed to implement a rapid movement in approaching a workpiece until contact is effected. The movement of the apparatus upon contact with the workpiece is then transformed to a slow, more powerful working mode.

2. DESCRIPTION OF THE PRIOR ART

The prior art reveals a wide variety of fluid powered devices that employ a plurality of cylinder and piston combinations to control the speed and force of the device as an element thereof advances toward a workpiece.

In general, most of the prior art devices utilize a tandem arrangement for the various pistons that are all contained within a single cylindrical housing.

By way of example, the present invention differs from the oleopneumatic jack that is shown and described in U.S. Pat. No. 3,426,530 entitled "Oleopneumatic Jack with Staged Structure" issued Feb. 11, 1969, to Alexander Georgelin. The jack has a cylindrical tubular body structure with end caps attached thereto. A first piston is positioned at one end within the cylindrical body. The piston has attached thereto an elongated hollow plunger that is adapted to move with the piston. A floating piston is positioned so that is slides freely along the previously mentioned hollow plunger. A third piston is positioned near the other end of the cylindrical body. The third piston has coupled thereto, as an integral part, a plunger that protrudes from the other end of the cylindrical body. The third piston contains a hollow central chamber which extents into a portion of an integral attached plunger. Air pressure is applied to one end of the floating piston thus causing it to urge oil against the third piston which in turn causes the plunger attached to the third piston to extend from the cylindrical body. After the initial rapid advancement of the first piston and the attached elongated hollow plunger, air pressure is introduced behind the first piston. As the first piston moves axially along the interior of the cylindrical body, its attached hollow plunger enters the oil filled chamber of the third piston thus causing it to move slowly while exerting a large force.

In U.S. Pat. No. 4,099,436 entitled "Apparatus for Piercing Sheet Material" issued July 11, 1978, to Donald Beneteau, there is described a force intensifier that employs an oil reservoir that is external of a cylindrical structure that contains a pair of pistons in axial alignment. The oil in the reservoir is forced into the cylinder by pressurized air that is in direct contact with the oil. The oil that is introduced into the cylinder moves one of the pistons. causing a tool carrying plunger to advance toward a workpiece. In order to intensify the force delivered by the tool carrying plunger, air is introduced behind the other piston, causing it to move an attached plunger into a constricted cavity where the oil pressure is greatly increased, thereby exerting an even greater force on the tool carrying plunger.

One of the disadvantages of the above described apparatus is that its position cannot be readily changed because of the air-oil interface in the reservoir.

An additional load producing cylinder is shown in FIG. 3 of U.S. Pat. No. 4,395,027 entitled "Pressure Intensifying Device" issued July 26, 1983. to Robert Nordmeyer. FIG. 3 of the above referenced patent depicts a cross-sectional view of a pressure intensifying device that has an essentially cylindrical configuration. There is a first piston and plunger combination that moves in the direction towards a second piston plunger combination. The first piston moves under the influence of air pressure and returns to its original position by the biasing action of a compression spring. The second piston is essentially hollow and is filled with oil that supplies the force that causes the second piston and plunger to move linearly. After the second piston has accomplished its initial movement, the first piston plunger is advanced into the oil filled chamber of the second piston. The force on the second piston is thus intensified. The cylinder contains an internally positioned oil reservoir through which the first piston plunger passes. The just mentioned device utilizes, in tandem, pistons that move in the same direction during the initial or advancement movement. One of the inherent drawbacks of the just described device is its overall length. Then, too, the spring that is biased against the first piston subtracts from the overall load that is applied by air pressure.

The present invention also employs a floating piston, however, its direction of motion is opposite to the floating piston shown in U.S. Pat. No. 3,426,530. Thus, the present invention can accomplish the same function as U.S. Pat. No. 3,426,530 within a smaller space. When large numbers of load intensifiers are utilized in close proximity to one another space is always at a premium.

The present invention does not have an air-oil interface since the oil is contained completely within the confinement of the apparatus. Also, the present invention utilizes a reverse direction floating piston concept to reduce the overall length of the apparatus. The present invention also has a plunger unit that is separate from the load enhancement plunger.

The present invention does not utilize springs to aid in the movement of the pistons. Also, the present invention is not arranged in a continuous linear array as is the device described in U.S. Pat. No. 4,395,027.

SUMMARY OF THE PRESENT INVENTION

The present invention is a load intensifier apparatus for use in any application where a linear force of considerable magnitude is required such as in metal shaping, punching, clamping and welding.

The invention includes a two part housing wherein the second portion of the housing can be arranged at any attitude with respect to the first portion of the housing. The first portion of the housing contains an enclosed oil reservoir that is in communication with the second housing. The first housing contains a floating piston that moves along the piston rod of an intensifier piston. The second housing contains a piston and a piston rod that extends from the housing. In the first housing, air pressure is introduced to one side of the floating piston causing a volume of oil located on the other side of the floating piston to move into the second housing where its pressure causes the piston within the second housing to undergo rapid movement to advance the attached piston rod toward a workpiece. After the rapid movement of the piston in the second housing has occurred, the pressure intensifier piston within the first housing is moved under the influence of air pressure. The end of the piston rod of the intensifier piston then enters a constricted oil passageway causing a slow but intense movement of the piston in the second housing. The further movement of the piston causes its piston rod to additionally bias itself against the workpiece.

A primary object of the present invention is to provide a force intensifier apparatus that is compact and can function with a variety of tools attached thereto.

Another object of the present invention is to provide an apparatus that utilizes two separable housings so that the apparatus can be employed in confined spaces.

A further object of the present invention is to provide an apparatus wherein the externally applied motivating force is pneumatic utilizing a fire retardant fluid.

Another object of the present invention is to provide an apparatus that contains a completely enclosed hydraulic circuit which will properly operate in any degree of orientation with reference to gravity.

Still another object of the present invention is to provide two distinct housing portions located at selectively spaced apart locations, each of which lends itself to rapid replacement and repair.

A further object of the present invention is to minimize the axial length of the overall device and thereby conserve space.

A yet further object of the present invention is to provide an apparatus that utilizes, initially, a fast stroke followed by a low impact stroke to contact the workpiece and rapid pressure build up to hold the workpiece.

Another object of the present invention is to provide a visual capability to detect if the hydraulic oil needs replenishing and allow refilling, if needed, without removing the unit from the machine.

Still another object of the present invention is to provide an apparatus which utilizes one valve to operate forward stroke, intensifier stroke and return stroke thereby keeping the cycle time to a minimum.

A further object of the present invention is to provide an apparatus that has a load cell to indicate the position of work and to display the pressure holding the workpiece while not experiencing any impact loads on the load cell.

Further objects and advantages of the present invention will become apparent from the following description and the appended claims, reference being made to the accompanying drawings forming a part of this specification, wherein like reference characters designate corresponding parts in several views.

DETAILED DESCRIPTION OF THE PREFERRED EMBODIMENT

Figure 1:
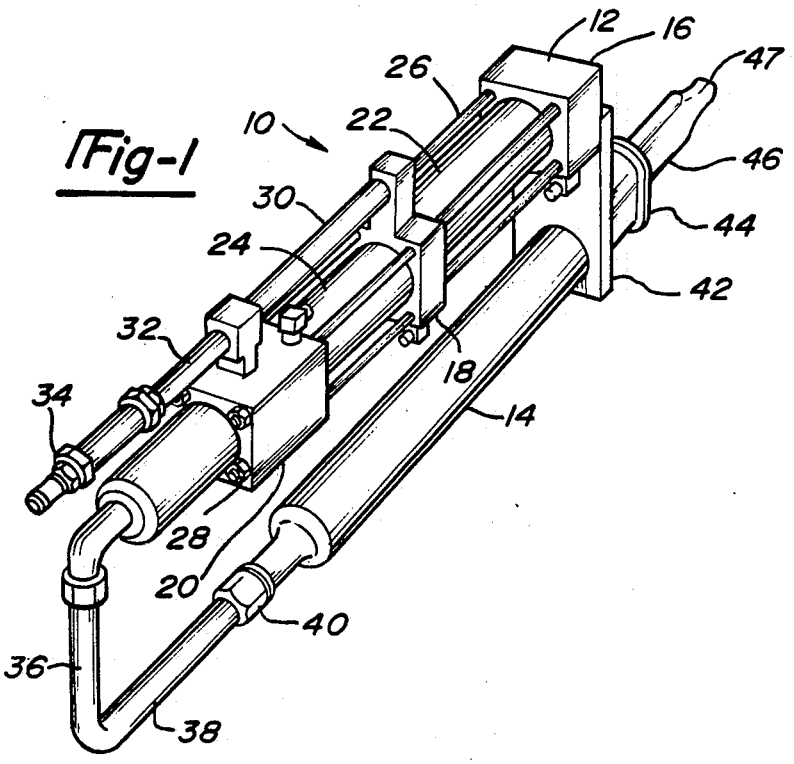
FIG. 1 is a perspective view that shows a preferred embodiment of the force intensifier of the present invention.

Referring now to the drawings and more particularly to FIG. 1, there is illustrated in perspective one configuration of the present load intensification apparatus. The overall apparatus is identified by the numeral 10. The overall apparatus 10 has two distinct subassemblies or housings which shall hereinafter be identified as the master cylinder 12 and the actuating cylinder 14. The master cylinder 12 is essentially a hollow structure with a front manifold 16, a center manifold 18 and a rear manifold 20 that are in spaced apart, axially aligned relationship to one another. A cylindrically shaped thin-walled front sleeve 22 is positioned between the front manifold 16 and the center manifold 18. A similar cylindrically shaped rear sleeve 24 is positioned between the center manifold 18 and the rear manifold 20. The master cylinder 12 is held together by studs 26 that pass through each one of the manifolds 16, 18, and 20. The studs 26 are threaded on each end and tension thereon is maintained by threaded nuts 28. A viewing tube 30 for the hydraulic fluid contained within the master cylinder 12 spans the distance between the center manifold 18 and the rear manifold 20. A nipple 32 is positioned in axial alignment with the viewing tube 30 and a quick disconnect fitting 34 is coupled to the cantilevered end of the nipple 32. The quick disconnect fitting 34 provides for easy access to the hydraulic system should the addition of hydraulic fluid become necessary.

A compression fitting 90° elbow 36 is attached to the rear manifold 20. The elbow 36 is in turn coupled with an elastomeric tube 38 that is made of urethane or other suitable material that can withstand contact with hydraulic oil and reasonable pressures generated thereby. The elastomeric tube 38 is coupled to a straight compression fitting 40.

The actuating cylinder 14 is essentially cylindrical throughout its internal and external configuration and at the back end has a tapped hole to accept the compression fitting 40. The front end of the actuating cylinder is supported by a mounting plate 42. The mounting plate 42 is cantilevered in a downward direction from its rigid support on the front manifold 16. While the actuating cylinder 14 is shown in a parallel attitude with respect to the master cylinder 12, it is readily understandable that the flexible nature of the elastomeric tube 38, as well as its selectable varying length permits orientation or positioning of the actuating cylinder 14 to assume any location with respect to the master cylinder 12. A retaining bushing 44 is attached to the front end of the actuating cylinder 14. The retaining bushing 44 permits the end of a piston rod 46 to protrude therefrom. By way of example, a tool 47 such as an electrode for welding purposes can be affixed to the cantilevered end of the piston rod 46.

Figures 2, 3:
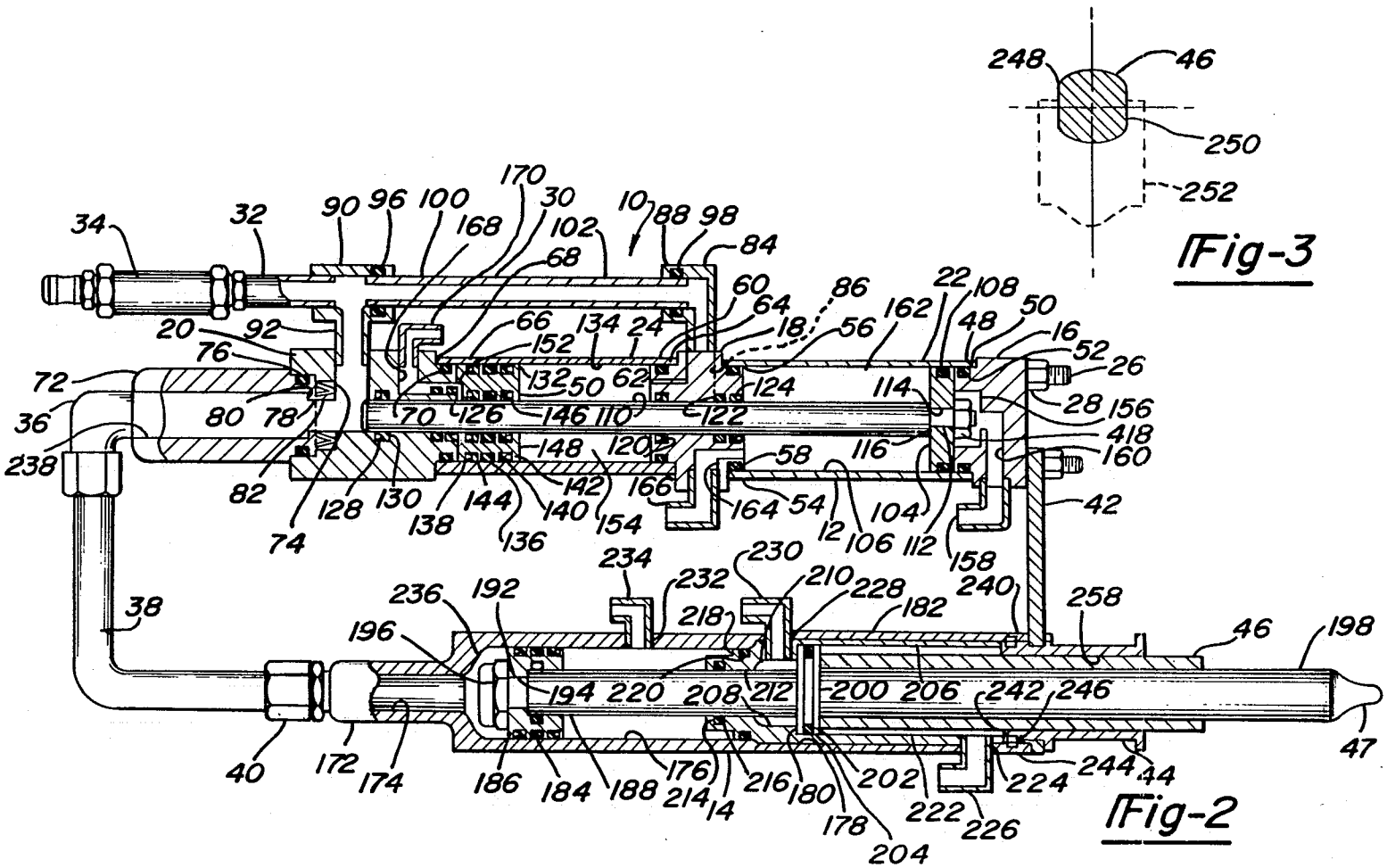
FIG. 2 is a cross-sectional side view showing the pistons and their interrelationship to one another.
FIG. 3 is a cross-sectional view taken along section lines 3—3 of FIG. 2 that shows the flat sections of the piston rod.

FIG. 2 is a cross-sectional view of the overall apparatus 10 that is depicted in FIG. 1. FIG. 2 shows the pistons and their interrelationship to one another. The front sleeve 22 can, if desired, have the same overall dimensions as the rear sleeve 24. The front and rear sleeves 22 and 24 are preferably manufactured from steel. The leading end 48 of the front sleeve 22 fits over a machined boss 50 on the front manifold 16. Even though close tolerances are maintained between the inside diameter of the front sleeve 22 and the outside diameter of the boss 50, it is desirable to utilize an O-ring seal 52. The trailing end 54 of the front sleeve 22 fits over a machined boss 56 on the center manifold 18. An O-ring 58 is utilized between the boss 56 and the interface with the front sleeve 22 to ensure a fluid tight joint. The leading end 60 of the rear sleeve 24 fits over a machined boss 62 on the center manifold 18. An O-ring 64 is positioned so that it effects a fluid tight seal between the inside surface of the rear sleeve 24 and the boss 62. The trailing end 66 of the rear sleeve 24 fits over a machined boss 68 on the rear manifold 20. An O-ring 70 is used to ensure a fluid tight seal between the inside surface of the rear sleeve 24 and the boss 68. An end cap 72 is attached to the trailing end of the rear manifold 20. The end cap 72 has a threaded section that engages similar threads in an axially aligned bore 74 in the rear manifold 20. An O-ring 76 is utilized to maintain a fluid tight seal between the end cap 72 and the rear manifold 20. The end cap 72 has a reduced diameter bore 78 that contains a groove 80 for an elastomeric seal 82. The purpose of the reduced diameter bore 78 will be discussed in more detail below.

The center manifold 18 has a 90° elbow fitting 84 threadedly engaged in an upper threaded bore 86. The elbow fitting 84 has its non-threaded end 88 directed toward the left or toward the rear manifold 20. A tee fitting 90 has its stem end 92 threadedly engaged within a threaded lower bore 94 in the rear manifold 20. The lower bore 94 is located on the top of the rear manifold 20. The top of the tee fitting 90 is aligned so that its axis is parallel with the longitudinal axis of the master cylinder 12. The viewing tube 30 is aligned between the tee fitting 90 and the end 88 of the elbow fitting 84. O-ring seals 96 and 98 effect seals at the leading and trailing ends 100 and 102 of the viewing tube 30 with the respective elbow fitting 84 and tee fitting 90. The viewing tube 30 can be fabricated from tempered glass tubing or high strength plastic material. The nipple 32 is threadedly attached to the end of the tee fitting 90 and the quick disconnect fitting 34 is attached to the nipple 32. Thus, the quick disconnect fitting 34, the nipple 32, and the viewing tube 30 are in axial alignment with one another.

An intensifier piston 104 is positioned within a bore 106 in the front sleeve 22. The intensifier piston 104 is sealed against the bore 106 by means of an O-ring 108. An intensifier rod 110 is centrally attached to the intensifier piston 104. A reduced diameter end 112 of the intensifier rod 110 is positioned within a bore 114 in the intensifier piston 104. The intensifier piston 104 abuts against a shoulder 116 on the intensifier rod 110. The shoulder 116 is formed by the reduced diameter end 112. The intensifier piston 104 is immobilized by the attachment of a nut 118 to a threaded portion of the reduced diameter end 112. The intensifier rod 110 passes through a bore 120 that is located in the center manifold 18. A groove 122 within the bore 120 carries an O-ring 124 providing for a seal between the center manifold 18 and the intensifier rod 110. The intensifier rod 110 also passes through a bore 126 that is located within the rear manifold 20. A seal is maintained between the rear manifold 20 and the intensifier rod 110 by means of an O-ring 128 that is positioned within a groove 130 in the wall of the bore 126.

A floating reservoir piston 132 is trained over the intensifier rod 110. The reservoir piston 132 is positioned within a bore 134 in the rear sleeve 24. The reservoir piston 132 is sealed against the surface of the bore 134 by means of an O-ring 136 and wiper seals 138 and 140 that are positioned on each side of the O-ring 136. The O-ring 136 and accompanying wiper seals 138 and 140 are positioned within a groove 142 that is located in a peripheral surface of the reservoir piston 132. The floating reservoir piston 132 is also sealed against the intensifier rod 110 along which it slides. A glide or wiper ring 144 and an adjacent O-ring 146 are positioned in grooves 148 and 150, respectively. The positioning of the floating reservoir piston 132 on the intensifier rod 110 creates two fluid chambers 152 and 154 within the area of the rear sleeve 24. The first fluid chamber 152 lies between the rear manifold 20 and the floating reservoir piston 132. The second fluid chamber 154 lies between the center manifold and the floating reservoir piston 132.

The front manifold 16 contains a fluid chamber 156 and an elbow fitting 158 that is threaded into a threaded bore 160 of the front manifold. The bore 160 is in communication with the fluid chamber 156 and the elbow fitting 158. An additional fluid chamber 162 lies between the intensifier piston 104 and the center manifold 18. The center manifold 18 contains the upper bore 86 that is in communication with the second chamber 154 and the interior of the elbow 84. A lower bore 164 is in communication with the chamber 162 and an elbow 166 that is threaded into the bottom of the center manifold 18. The rear manifold 20 contains a bore 168 that is in communication with the first chamber 152 and the interior of an elbow fitting 170 that is anchored in the rear manifold 20.

The actuating cylinder 14 has an external cylindrical configuration over its axial extent. The rear portion of the actuating cylinder 14 has a section 172 of reduced external diameter. The end of the section 172 contains a bore 174 that is threaded (not shown) for coupling with the compression fitting 40. The interior of the actuating cylinder 14 is formed by an axial bore 176 that extends over approximately the rear one half of the actuating cylinder 14. The remaining or forward one half of the interior of the actuating cylinder 14 is formed by an axially extending bore 178 that is of greater diameter than the axial bore 176 of the rear half of the actuating cylinder. A radially extending shoulder 180 forms the intersection between the bores 176 and 178. A sleeve 182 is positioned primarily within the bore 178 of the actuating cylinder 14. A portion of the sleeve 182 is of reduced external diameter so that it fits within the bore 176. The reduced external diameter portion of the sleeve 182 creates a reentrant notch that coacts with the shoulder 180 of the actuating cylinder 14. The shoulder 180 acts as a stop for the sleeve 182 thus defining its axial position within the actuating cylinder 14.

A rear piston 184 is positioned within the bore 176. The rear piston 184 has an O-ring seal 186 positioned within a groove 188 located in the cylindrical exterior surface of the rear piston 184. The piston rod 46 has one end thereof attached to the rear piston 184. The piston rod 46 has a reduced diameter end portion 192 that extends through an axially aligned bore 194 in the rear piston 184. The rear piston 184 is attached to the piston rod 46 by means of a threaded nut 196 that engages threads (not shown) on the end of the reduced diameter end portion 192 of the piston rod 46. The piston rod 46 extends from the rear piston 184 through the entire axial extent to the right, as viewed in FIG. 2, where it exits as an unencumbered cantilevered end 198.

Returning once again to the sleeve 182, a forward piston 200 is machined into the piston rod 46 as an integral part thereof. The forward piston 200 is located generally toward the mid-portion of the axial extent of the piston rod 46. The forward piston 200 has a peripheral groove 202 that contains an O-ring 204. The sleeve 182 accommodates the forward piston 200 within a bore 206. The O-ring seal 204 seats against the surface of the bore 206. The sleeve 182 contains a second bore 208 that can be seen in FIG. 2 to the left of the forward piston 200. The second bore 208 forms a chamber 210 between the internal surface of the second bore 208 and the external surface of the piston rod 46. The sleeve 182 contains a third bore 212 that permits the piston rod 46 to pass therethrough. The bore 212 contains a groove 214 in which an O-ring 216 is positioned for providing a seal between the sleeve 182 and the piston rod 46. The sleeve 182 contains a groove 218 positioned in its external surface so that an O-ring 220 can be placed therein to effect a seal between the sleeve 182 and the bore 176 of the actuating cylinder 14.

The section of the piston rod 46 located to the right of the forward piston 200, as viewed in FIG. 2, has a diameter that is less than the bore 206 of the sleeve 182, thus forming a chamber 222. The chamber 222 has a bore 224 that is in communication with an elbow fitting 226. In a similar manner, the chamber 210 has a bore 228 that is in communication with an elbow fitting 230. A chamber 231, which is positioned to the right of the rear piston 184, has a bore 232 that is in communication with an elbow fitting 234, and, a chamber 236, located to the left of the rear piston 184, is in communication with the second chamber 154 of the master cylinder 12 via the bore 174, the elastomeric tube 38, the elbow 36, a bore 238 in the end cap 72, the bore 78, the bore 94 and the viewing tube 30 and its included elbow and tee fittings.

The retaining bushing 44 is supported by the mounting plate 42. The mounting plate 42 is anchored to the front manifold 16 by the studs 26 and the nuts 28. The retaining bushing 44 has an external part cylindrical section 240 that fits into the bore 178. The retaining bushing 44 is immobilized by means of a retaining ring 242 that coacts with a groove 244 in the wall of the bore 178 in the actuating cylinder 14 and with a groove 246 that is milled in the external surface of the part cylindrical section 240.

FIG. 3 is a cross-sectional view taken along the section lines 3—3 of FIG. 2. The piston rod 46 contains a milled planar area 248 on one side and a similar milled planar area 250 on the other side thereof. The milled planar areas 248 and 250 interact with a bifurcated support 252, the arms of which extend vertically along a portion of each of the milled planar areas 248 and 250. The bifurcated support 252 is shown in phantom lines since it is not considered to be an essential component of the present invention. The purpose of the milled planar areas 248 and 250 is to provide a degree of rigidity to the piston rod 46 so that it will not rotate and cause misalignment with a nonsymmetrical tool 47 that may be affixed to the end 198 of the piston rod 46.

Figure 4:
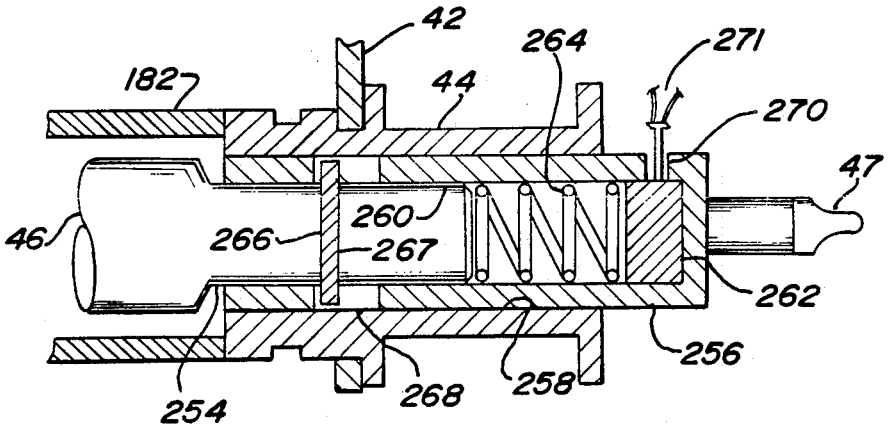
FIG. 4 is a part sectional view of an embodiment that employs a load cell near the end of the working piston rod.

FIG. 4 is a part sectional view of an embodiment that employs a load detection device within the piston rod 46 of the actuating cylinder 14. FIG. 4 shows the sleeve 182, the mounting plate 42 and the retaining bushing 44 similar to like components shown in FIG. 2. The piston rod 46 has a reduced diameter cylindrical section 254. The cylindrical section 254 telescopes within a piston rod adapter 256. The piston rod adapter 256 has an external cylindrical surface that fits within a bore 258 in the retaining bushing 44. The piston rod adapter 256 has an internal bore 260 into which the telescoping end of the piston rod 46 fits. A load cell 262 is positioned within the bore 260 and a compression spring 264 is aligned within the bore 260 between the end of the piston rod 46 and the load cell 262. In order to retain the piston rod adapter 256 on the end of the piston rod 46, a pin 266 is installed in a bore 267 that is diametrically aligned with respect to the piston rod 46. The pin 266 protrudes beyond the external surface of the cylindrical section 254. The ends of the pin 266 fit into slots 268 that are milled into the piston rod adapter 256. In this manner, the piston rod adapter 256 has a limited degree of axial movement with respect to the piston rod 46. The piston rod adapter 256 has a radially aligned bore 270 that permits electrical lead wires 271 of the load cell 262 to exit the interior of the piston rod adapter 256. During operation of the overall apparatus the piston rod 46 causes the compression spring 264 to exert a force on the load cell 262. After the load has been released from the load cell, the compression spring 264 will cause the piston rod adapter 256 to move axially subject to the constraints of the pin 266 and the slots 268.

ASSEMBLY AND OPERATION

During the assembly of the overall apparatus 10, great care must be taken to preserve the integrity of the seals, particularly the O-rings which are subject to the nicks caused by assembly. The master cylinder is assembled by installing the appropriate seals on the reservoir piston 132 and the intensifier piston 104. The intensifier piston 104 is affixed to the end of the intensifier rod 110 by the nut 118. The intensifiier rod 110 is then inserted through the bore 120 in the center manifold 18. The reservoir piston 132 is then slid over the free end of the intensifier rod 110. The front and rear sleeves 22 and 24 are then installed over the respective bosses 56 and 62 on the center manifold 18. The front and rear manifolds 16 and 20 are then positioned so that their respective bosses 50 and 68 slide within the ends of the front and rear sleeves 22 and 24. The four studs 26 are then installed in the holes (not shown) within the front, center and rear manifolds 16, 18 and 20. The studs 26 are then tensioned by the installation of the nuts 28. The elbow fittings 158 and 170 along with the elbow 166 are then installed in their respective manifolds. The tee fitting 90 and the elbow 84 are installed in the rear and center manifolds 20 and 18, respectively. The viewing tube 30 is then installed along with the appropriate O-ring seals 96 and 98. The nipple 32 and its accompanying quick disconnect fitting 34 is then installed to the tee fitting 90. The end cap 72, the elbow 36 and the elastomeric tube 38 are then attached to the rear manifold 20.

During the assembly of the actuating cylinder 14, the sleeve 182 is positioned over the left end (as viewed in FIG. 2) of the piston rod 46. Next, the rear piston 184 is affixed to the end of the piston rod 46 by the nut 196. The rear piston 184, the piston rod 46 and the sleeve 182 are installed within the bores 176 and 178 of the actuating cylinder 14. The retaining bushing 44, and its accompanying mounting plate 42, is then slid over the free end of the piston rod 46. The lower two nuts 28 on the studs that protrude from the front manifold are removed to permit installation of the mounting plate 42. The retaining bushing 44 is then moved into locking arrangement with the retaining ring 242. The nuts 28 are reinstalled on the studs 26, anchoring the mounting plate 42 to the front manifold. The elbow fittings 226, 230 and 234 are then installed in the actuating cylinder 14. The compression fitting 40 is then attached to the end of the section 172 of the actuating cylinder 14.

Figure 5:
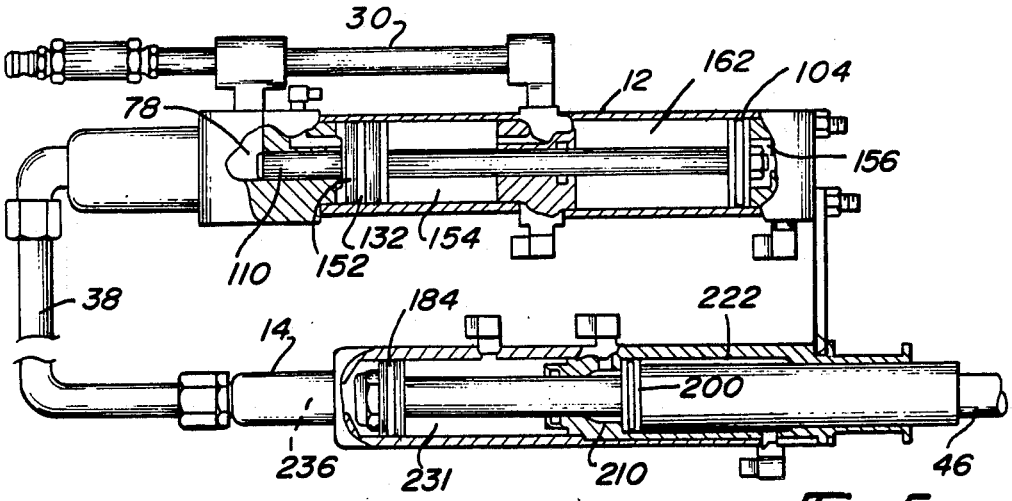
FIG. 5 is a cross-sectional view that shows the position of the pistons and piston rods in the fully retracted position.

FIG. 5 is a cross-sectional view that shows the position of the pistons and piston rods when the overall apparatus 10 is in the fully retracted position. At the commencement of a cycle of the overall apparatus 10, the intensifier piston 104 is to the extreme right end of the chamber 162. as viewed in FIG. 5. Consequently, the end of the intensifier rod 110 is retracted to a position clear of the bore 78. The reservoir piston 132 is to the extreme left end of the second chamber 154. In the actuating cylinder 14 portion of the overall apparatus 10, the rear piston 184 is positioned toward the left end of the chamber 231, therefore, the extreme right free end of the piston rod 46 is nearly retracted within the confinement of the actuating cylinder 14. The forward piston 200, which is an integral part of the piston rod 46, is positioned at the left end of the chamber 222.

Figure 6:
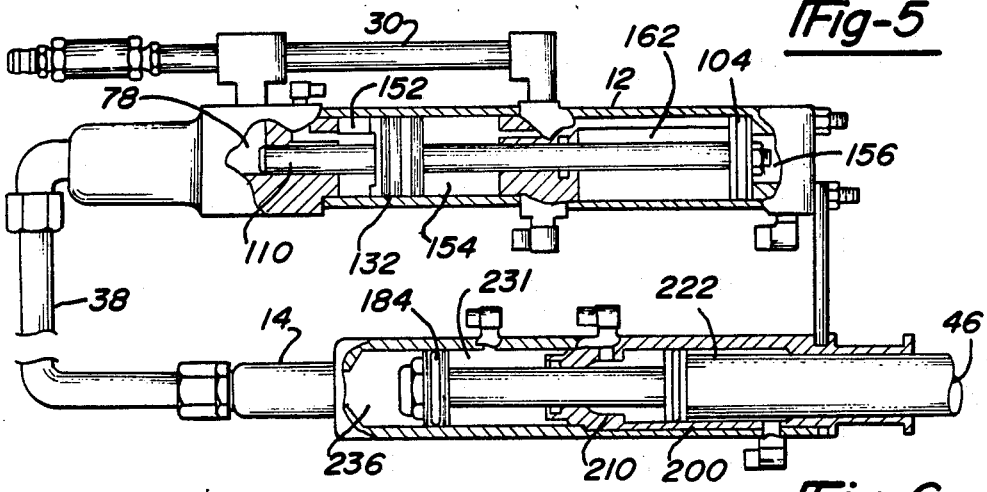
FIG. 6 is a cross-sectional view that shows the position of the pistons and piston rods after pressure has been applied to the reservoir piston.

FIG. 6 is a cross-sectional view that shows the position of the pistons and piston rods after the overall apparatus 10 has been actuated to begin a work cycle. Air pressure is introduced to the chamber 152 causing the reservoir piston 132 to move toward the right. The oil to the right of the reservoir piston 132 begins to exit the second chamber 154 and travel via the viewing tube 30 and the elastomeric tube 38 into the chamber 236. The increase in volume of oil in the chamber 236 causes the rear piston 184 to move rapidly to the right. As the rear piston moves toward the right, air is exhausted from the chamber 231. Since the forward piston 200 is a part of the piston rod 46, the forward piston 200 also moves toward the right thus causing an ingress of air into the chamber 210 and an egress of air from the chamber 222. After the initial introduction of air pressure to the chamber 152 at the left of the reservoir piston 132 there is a rapid deployment of the piston rod 46 to the right where its travel is halted by an interception with, for example, a workpiece.

Figure 7:
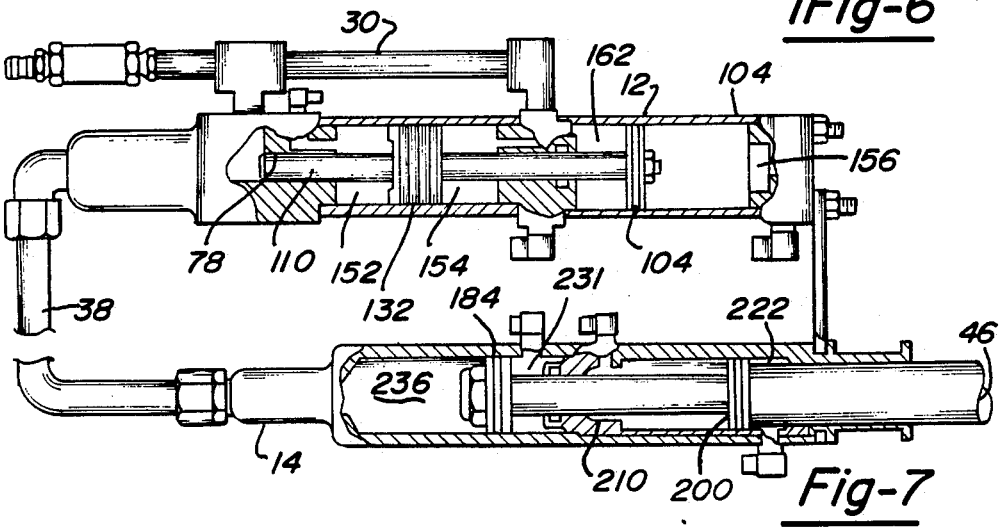
FIG. 7 is a cross-sectional view similar to that shown in FIGS. 5 and 6 except that intensification has occurred.

FIG. 7 is a cross-sectional view similar to that shown in FIGS. 5 and 6 that shows the final stage of the work cycle of the overall apparatus 10. Since rapid deployment of the piston rod 46 has brought a tool (not shown) carried by it into contact with a workpiece, the load must be increased beyond the capability of the air pressure normally found at an industrial site. Consequently, air pressure is introduced into the chamber 156 which is positioned to the right of the intensifier piston 104. As the intensifier piston 104 moves to the left, the tip of the intensifier rod 110 enters the bore 78 in the rear manifold thus causing the oil trapped before it to act as a closed loop system between the intensifier rod 104, bore 78 and the chamber 236. The continued travel of the intensifier piston rod 110 into the bore 78 acts on the oil in the chamber 236 urging the rear piston 184 to the right, delivering a greatly increased force to the piston rod 46. The actual movement of the piston rod 46 has been exaggerated in FIG. 7 for purposes of illustrating the movement thereof. The increased movement of the forward piston 200 to the right will exhaust additional air from the chamber 222 and cause an influx of additional air into the chamber 210. If an additional force is desirable in the piston rod 46, air pressure above ambient can be introduced into the chamber 210. Thus, there will be a combined hydraulic, as well as intensifying, force introduced to the piston rod 46.

Figure 8:
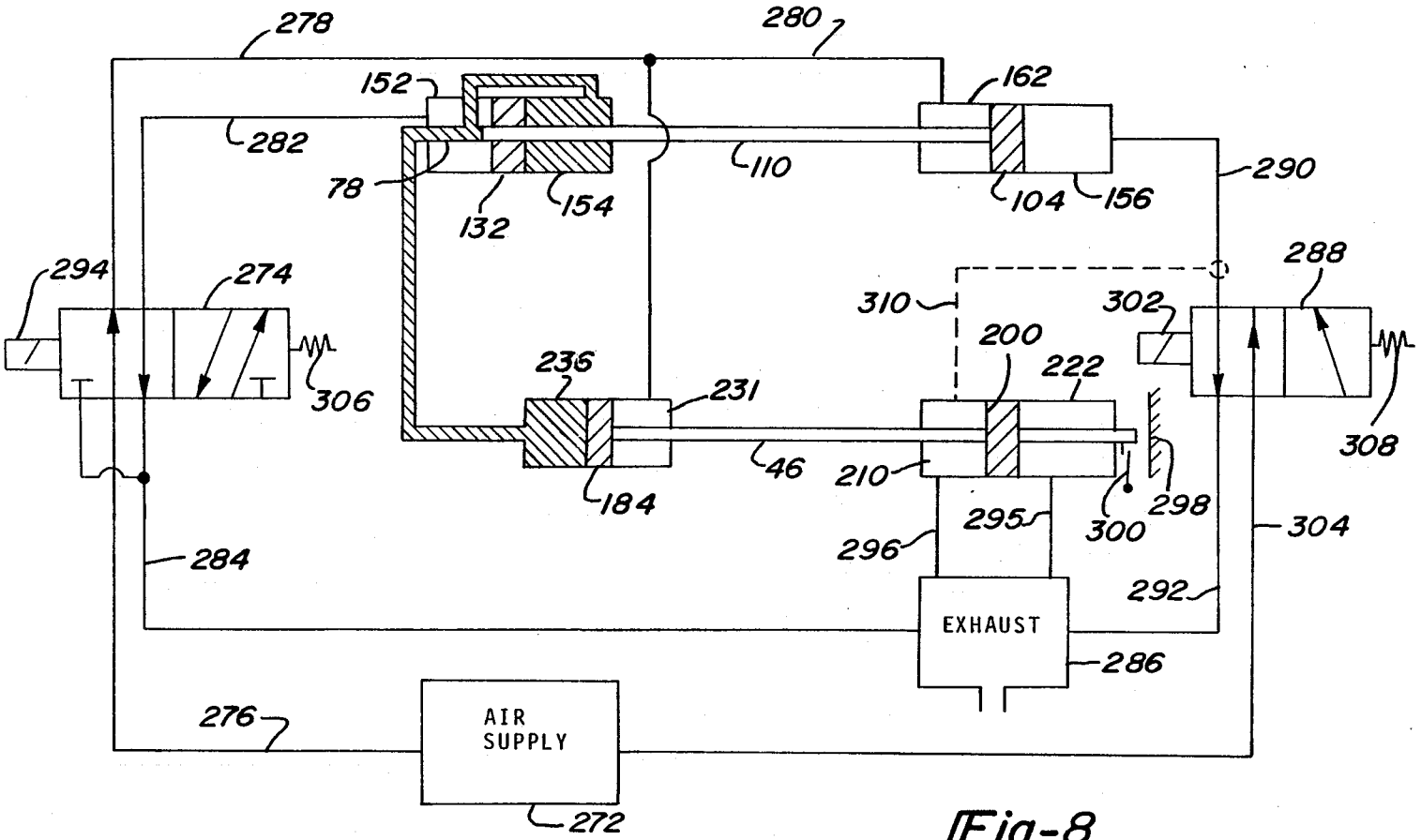
FIG. 8 is a schematic view that shows the valving system utilized with the present apparatus.

FIG. 8 is a schematic fluid diagram according to the present invention and the controls that achieve the fluid motion. For purposes of the present invention the fluids have been described as air and oil. FIG. 8 shows a simplified layout of the pistons and piston rods. Since the oil within the overall apparatus 10 is self-contained, the oil has been shown for clarity as sectioned. In order to operate the overall apparatus through its entire work cycle, only external air pressure need be applied. For purposes of explanation, it is assumed the overall apparatus 10 is coupled to an air supply 272. Air under pressure is supplied to a three-way valve mechanism 274 which is a solenoid actuated spring return device. The air under pressure exits the air supply through a line 276 and travels through the valve mechanism 274 to a line 278 and to the chamber 231. The line 278 also supplies air under pressure to a line 280 which is connected to the chamber 162. The air pressure supplied to the chamber 231 causes the rear piston 184 to move to the left forcing the oil from the chamber 236 into the second chamber 154 and urging the reservoir piston 132 to the left. As the reservoir piston 132 moves to the left, air is exhausted from the chamber 152 through a line 282 to the valve mechanism 274 which permits the expelled air to enter a line 284 and travel to an exhaust port 286 which may, if desired, be a device such as a muffler to attenuate the noise level of the exhausting air. The air pressure delivered via the line 280 to the chamber 162 causes the intensifier piston 104 to remain to the right, ensuring that the tip of the intensifier rod 110 does not impede the flow of oil into the second chamber 154. The chamber 156 is connected to a two-way valve mechanism 288 by a line 290. In the unenergized position, the valve mechanism 288 permits the exhaust air from the line 290 to enter a line 292 and pass to the exhaust port 286. At the start of the cycle, a solenoid 294 on the valve mechanism 274 is energized by the movement of a workpiece into a work station or by other means that connects an electrical source to the solenoid. The energizing of the solenoid 294 connects the air supply line 276 to the line 282 pressurizing the first chamber 152, which causes the reservoir piston 132 to move to the right, forcing oil from the second chamber 154 to the chamber 236. Oil entering the chamber 236 causes the rear piston 184 to move rapidly to the right, hence the piston rod 46 moves to the right along with the forward piston 200. The energizing of the solenoid 294 on the valve mechanism 274 causes the chambers 231 and 162 to become connected to the exhaust line 284. As the forward piston 200 moves to the right, air is exhausted from the chamber 222 through a line 295 and air from the exhaust port 286 is drawn through a line 296 to the chamber 210. After the piston rod 46 has made its rapid advance toward and against a workpiece such as is identified by numeral 298, the pressure, or an electrical switch such as 300, energizes a solenoid 302 on the valve mechanism 288 causing a blocked line 304 to be connected to the line 290. The air pressure delivered by the line 290 to the chamber 156 causes the intensifier piston 104 to move to the left thus permitting the tip of the intensifier rod 110 to enter the bore 78 which causes an intensified oil pressure in the chamber 236. The increased force supplied to the rear piston 184 is transferred to the piston rod 46 and to the workpiece 298. At the command of an operator or by automatic timing the solenoids 294 and 302 are deenergized, permitting springs 306 and 308 to return the valve mechanisms 274 and 288 to their original starting positions. It is to be noted that by utilizing oil to push the reservoir piston backwards as well as forwards, any contaminated air in the closed loop system will collect harmlessly in the reservoir.

By way of illustration, the intensifier rod 110 has a diameter of 0.5 inches and the intensifier and rear pistons 104 and 184 each have a diameter of 1.75 inches. Since the increase in the pressure delivered to the rear piston 184 varies as the square of the diameter, 1.75 squared divided by 0.5 squared yields a pressure increase of 12.25. Thus, if typical shop air at 80 p.s.i. is delivered to the intensifier piston, there will be 980 psi delivered to the rear piston 184. Depending, of course, on the area of the forward piston 200, the load resulting from the 980 psi delivered to the rear piston 184 can be increased by supplying 80 psi air to the forward piston 200 via an additional air supply line 310 and closing the exhaust line 296.

While the illustrative embodiment of the invention has been described in considerable detail for the purpose of setting forth practical operative structures whereby the invention may be practiced, it is to be understood that the particular apparatus described is intended to be illustrative only, and that the various novel characteristics of the invention may be incorporated in other structural forms without departing from the spirit and scope of the invention defined in the appended claims.

What is claimed is:

1. An apparatus for intensifying a force that is applied to a tool to move said tool into and out of engagement with a workpiece, said apparatus comprising:

a master cylinder having a first manifold, a second manifold adjacent said first manifold and a third manifold spaced relative said first and second manifolds, said first, second and third manifolds each having at least one aperture therein, said first, second and third manifolds being axially aligned and in spaced apart relationship to one another;

means for forming a first cavity between said first and second manifolds;

means for forming a second cavity between said second and third manifolds;

an intensifier piston positioned in said first cavity, said intensifier piston defining first and second chambers in said first cavity;

a reservoir piston positioned in said second cavity, said reservoir piston defining third and fourth chambers in said second cavity, said reservoir piston having a central bore therein;

an intensifier rod coupled to said intensifier piston, said intensifier rod passing through said at least one aperture in said second manifold and said central bore of said reservoir piston;

an actuating cylinder positioned in juxtaposed relationship with respect to said master cylinder;

means for forming a third cavity within said actuating cylinder;

a piston positioned in said third cavity of said actuating cylinder, said piston defining fifth and sixth chambers on each side of said piston; said third chamber adjacent said reservoir piston and said sixth chamber adjacent said piston each containing hydraulic fluid;

passage means for placing said third and sixth chambers in fluid communication with each other, said passage means communicating with said second and third manifold at one end and having an opposite end attached to said actuating cylinder;

a piston rod attached to said piston, said piston rod having a free end cantilevered from said actuating cylinder;

means for introducing pressurized pneumatic fluid to said fourth chamber adjacent said reservoir piston to cause said reservoir piston to force hydraulic fluid from said reservoir piston third chamber into said actuating cylinder sixth chamber that is adjacent to said piston, such that said piston and said attached piston rod advances at a first predetermined rate toward said workpiece; and means for introducing pressurized pneumatic fluid to said first chamber adjacent said intensifier piston to cause said intensifier piston to move and further to move said coupled intensifier rod into one end of said passage means and act on said hydraulic fluid in said sixth chamber such that said hydraulic fluid is intensified for introduction to said actuating cylinder sixth chamber that is adjacent said piston to cause said piston rod attached to said piston to advance at a second predetermined rate toward said workpiece.

2. The apparatus of claim 1 wherein said means for forming said first and second cavities are hollow thin walled cylinders.

3. The apparatus of claim 1 wherein said passage means further comprises fluid viewing means positioned external of said master cylinder between said second and third manifolds for carrying fluid between said third and sixth chambers.

4. The apparatus of claim 3 wherein said fluid viewing means comprises an elbow fitting attached to said second manifold, a tee fitting attached to said third manifold and a viewing tube mounted between said tee and elbow fittings.

5. The apparatus of claim 4 wherein said viewing tube is transparent permitting visual monitoring of hydraulic fluid contained therein.

6. The apparatus of claim 1 wherein said first manifold further comprises an elbow fitting mounted to one of said at least one apertures to provide ingress for pneumatic fluid to pressurize said first chamber adjacent said intensifier piston.

7. The apparatus of claim 1 wherein said second manifold further comprises an elbow fitting mounted to one of said at least one apertures to provide ingress for pneumatic fluid to pressurize said second chamber adjacent said intensifier piston.

8. The apparatus of claim 1 wherein said third manifold further comprises an elbow fitting mounted to one of said at least one apertures to provide ingress for pneumatic fluid to pressurize said fourth chamber adjacent said reservoir piston.

9. The apparatus of claim 1 wherein said passage means further comprises an end cap attached to said third manifold, said end cap having a bore communicating with said at least one aperture in said third manifold.

10. The apparatus of claim 1 further comprising a passage means for supplying hydraulic fluid to said master cylinder.

11. The apparatus of claim 1 further comprising means for finding the location of said workpiece, said finding means being located adjacent said free end of said piston rod.

12. The apparatus of claim 11 wherein said means for finding the location of said workpiece comprises a load cell located adjacent said free end of said piston rod, said load cell being biased by said piston rod.

13. The apparatus of claim 12 further comprising a piston rod adapter mounted to said piston rod, said piston rod adapter having a radially aligned bore for egress of an electrical connection to said load cell.

14. The apparatus of claim 1 further comprising means for monitoring said intensified force applied to said tool to move said tool into and out of engagement with said workpiece, said monitoring means being located adjacent said free end of said piston rod.

15. The apparatus of claim 14 wherein said means for monitoring said intensified force comprises a load cell located adjacent said free end of said piston rod, said load cell being biased by said piston rod.

16. The apparatus of claim 15 further comprising a piston rod adapter mounted to said piston rod, said piston rod adapter having a radially aligned bore for egress of an electrical connection to said load cell.

17. An apparatus for intensifying a force that is applied to a tool to move said tool first rapidly, then slowly toward a workpiece, said apparatus comprising:

a master cylinder having a first manifold, a second manifold adjacent said first manifold and a third manifold spaced relative to said first and second manifolds, said first, second and third manifolds each having at least one aperture therein, said first, second and third manifolds being axially aligned and in spaced apart relationship to one another;

a first cylindrical sleeve attached to said first and said second manifolds to form a first cavity therebetween;

a second cylindrical sleeve attached to said second and said third manifolds to form a second cavity therebetween;

an intensifier piston positioned in said first cavity, said intensifier piston defining first and second chambers in said first cavity;

a reservoir piston positioned in said second cavity, said reservoir piston defining third and fourth chambers in said second cavity, said reservoir piston having a central bore therein;

an intensifier rod coupled to said intensifier piston, said intensifier rod passing through said at least one aperture in said second manifold and said central bore of said reservoir piston;

an actuating cylinder having an internal space therein positioned in juxtaposed relationship with respect to said master cylinder;

an apertured sleeve positioned within said actuating cylinder and bisecting said internal space within said actuating cylinder into third and fourth cavities;

a first actuating piston positioned in said third cavity of said actuating cylinder, said first actuating piston defining fifth and sixth chambers therein, said third chamber adjacent to said reservoir piston and said sixth chamber adjacent said first actuating piston each having hydraulic fluid passage means for placing said third and sixth chambers in fluid communication with one another to form a closed hydraulic system, said hydraulic fluid passage means of said third chamber having one end attached to said second manifold and an opposite end attached to said hydraulic fluid passage means of said sixth chamber;

a second actuating piston positioned in said fourth cavity of said actuating cylinder, said second actuating piston defining seventh and eighth chambers therein;

a piston rod attached to said actuating piston, said piston rod passing through said apertured sleeve;

said piston rod further being attached to said second actuating piston, said piston rod also being cantilevered from the end of said actuating cylinder;

means for introducing pressurized pneumatic fluid to said fourth chamber adjacent said reservoir piston to cause said reservoir piston to force hydraulic fluid from said reservoir piston third chamber into said actuating cylinder sixth chamber that is adjacent to said first actuating piston, such that said first actuating piston and said attached piston rod advances at a first predetermined rate toward said workpiece; and means for introducing pressurized pneumatic fluid to said first chamber adjacent said intensifier piston to cause said intensifier piston to move in association with said coupled intensifier rod into one end of said hydraulic fluid passage means and act on said hydraulic fluid such that said hydraulic fluid is intensified for introduction to said actuating cylinder sixth chamber that is adjacent said first actuating piston to cause said piston rod attached to said first actuating piston to advance at a second predetermined rate toward said workpiece.

18. The apparatus of claim 17 wherein said one end of said hydraulic fluid passage means of said third chamber further comprises fluid viewing means positioned external of said master cylinder between said second and third manifolds for carrying fluid between said third and sixth chambers.

19. The apparatus of claim 17 wherein said second actuating piston is formed as an integral part of said piston rod.

20. The apparatus of claim 17 further comprising fluid ingress means positioned in an outer wall of said actuating cylinder, said fluid ingress means providing communication between said fifth chamber adjacent said first actuating piston, said seventh chamber adjacent said second actuating piston, and said eighth chamber adjacent said second actuating piston.

21. The apparatus of claim 17 wherein a portion of said hydraulic fluid passage means of said sixth chamber is fabricated from a flexible nonmetallic material.

22. The apparatus of claim 17 wherein said hydraulic fluid passage means of said sixth chamber further comprises an end cap positioned adjacent said third manifold, said end cap having a passage therein.

23. The apparatus of claim 17 further comprising an annular retainer surrounding a portion of the axial extent of said piston rod and mounted to said actuating cylinder in abutting relationship therewith.

24. The apparatus of claim 23 wherein said actuating cylinder is coupled to said master cylinder.

25. The apparatus of claim 24 wherein said portion of said piston rod within said eighth chamber forward of said second actuating piston, and within said annular retainer is noncircular in configuration.

26. The apparatus of claim 17 wherein said first manifold and said third manifold are biased toward said second manifold by a plurality of tension studs, and firmly hold said master cylinder and said first and second cylindrical sleeves in position against said first, second and third manifolds.

27. The apparatus of claim 17 further comprising hydraulic ingress means, said hydraulic ingress means being provided for replenishing said hydraulic fluid in said closed hydraulic system.

28. An apparatus for intensifying a force that is applied to a tool to move said tool first rapidly, then slowly towards a workpiece, said apparatus comprising:

a master cylinder having a first manifold, a second manifold and a third manifold spaced relative to said first and second manifolds, said first, second and third manifolds each having at least one aperture therein, said first, second and third manifolds being axially aligned and in spaced apart relationship to one another;

a first cylindrical sleeve having a cylindrical bore, said first cylindrical sleeve being attached to said first and second manifolds to form a first cavity therebetween;

a second cylindrical sleeve having a cylindrical bore, said second cylindrical sleeve being attached to said second and said third manifolds to form a second cavity therebetween;

a plurality of tension studs passing through said first, second and third manifolds to bias said first, second and third manifolds against said first and second cylindrical sleeves;

an intensifier piston positioned in said first cavity, said intensifier piston defining first and second chambers in said first cavity;

a reservoir piston positioned in said second cavity, said reservoir piston defining third and fourth chambers in said second cavity, said reservoir piston having a central bore therein;

an intensifier rod coupled to said intensifier piston, said intensifier rod passing through said at least one aperture in said second manifold and said central bore of said reservoir piston;

said reservoir piston being adapted for sliding motion along a portion of the axial extent of said intensifier rod, said reservoir piston moving toward said intensifier piston during its power stroke;

an end cap with a bore therethrough attached to said third manifold;

a bore disposed within said second manifold, said bore being in communication with said third chamber adjacent said reservoir piston and a viewing tube positioned external of said master cylinder, a bifurcated bore within said third manifold in communication with said viewing tube, said third chamber adjacent said reservoir piston, and said bore within said end cap;

an actuating cylinder having an internal space therein positioned in juxtaposed relationship with respect to said master cylinder;

an apertured sleeve positioned within said actuating cylinder and bisecting said internal space within said actuating cylinder into third and fourth cavities;

a first actuating piston positioned in said third cavity of said actuating cylinder, said first actuating piston defining fifth and sixth chambers therein; said third chamber adjacent said reservoir piston and said sixth chamber adjacent said first actuating piston each containing hydraulic fluid;

a second actuating piston positioned in said fourth cavity of said actuating cylinder, said second actuating piston defining seventh and eighth chambers therein;

a piston rod attached to said first actuating piston, said piston rod passing through said apertured sleeve;

said piston rod being formed as an integral part of said second actuating piston, said piston rod further being cantilevered from the end of said actuating cylinder;

an elastomeric tube in communication with said bore in said end cap and said sixth chamber adjacent said first actuating piston, said elastomeric tube forming a closed hydraulic system;

pneumatic fluid ingress means within said third manifold for introducing pressurized pneumatic fluid to said fourth chamber adjacent said reservoir piston to cause said reservoir piston to force hydraulic fluid from said reservoir piston third chamber into said actuating cylinder sixth chamber that is adjacent to said first actuating piston, such that said first actuating piston and said attached piston rod advances at a first predetermined rate toward said workpiece;

pneumatic fluid ingress means positioned in said first manifold for introducing pressurized pneumatic fluid to said first chamber adjacent said intensifier piston to cause said intensifier piston to move and further to move said attached intensifier rod into said bore of said end cap and act on said hydraulic fluid such that said hydraulic fluid is intensified for introduction to said actuating cylinder sixth chamber that is adjacent said first actuating piston to cause said piston rod attached to said first actuating piston to advance at a second predetermined rate towards a workpiece;

an annular retainer positioned so that it surrounds a portion of the axial extent of said piston rod, said annular retainer being mounted to said actuating cylinder in abutting relationship therewith; and wherein said piston rod portion within said eighth chamber forward of said second actuating piston and within said annular retainer is noncircular in configuration.

29. The apparatus of claim 28 further comprising a quick disconnect fitting attached in communication with said viewing tube that is positioned external and adjacent to said master cylinder.

30. The apparatus of claim 28 wherein said annular retainer is coupled to said master cylinder with a rigid mounting plate.

31. The apparatus of claim 28 further comprising fluid ingress in the form of bore containing fitments positioned in an outer wall of said actuating cylinder, said bore containing fitments providing communication between said fifth chamber adjacent said first actuating piston, said seventh chamber adjacent said second actuating piston, and said eighth chamber adjacent said second actuating piston.

32. The apparatus of claim 28 further comprising a piston rod adapter telescoped over one end of said piston rod, said piston rod adapter being adapted for axial movement with respect to said piston rod.

33. The apparatus of claim 32 further comprising a spring interposed between said piston rod and said piston rod adapter.

34. The apparatus of claim 32 further comprising a load cell contained within said piston rod adapter, said load cell being biased by said piston rod.

35. The apparatus of claim 34 wherein said piston rod adapter has a radially aligned bore for egress of an electrical connection to said load cell.

36. The apparatus of claim 34 wherein said spring is positioned between said piston rod and said load cell.

* * * * *

UNITED STATES PATENT AND TRADEMARK OFFICE

CERTIFICATE OF CORRECTION

PATENT NO. : 4,961,317

DATED : October 9, 1990

INVENTOR(S) : Michael H. Wolfbauer, III

It is certified that error appears in the above-identified patent and that said Letters Patent is hereby corrected as shown below:

Column 1, line 62, delete the period "." and insert a comma ---- , ----.

Column 2, line 6, delete the period "." and insert a comma ---- , ----.

Column 9, line 15, delete the period "." and insert a comma ---- , ----.

In the Abstract

Line 6, delete "cylidner" and insert ---- cylinder ----.

Signed and Sealed this

Twenty-sixth Day of May, 1992

*Attest:*

*Attesting Officer*

DOUGLAS B. COMER

*Acting Commissioner of Patents and Trademarks*